US006209473B1

(12) United States Patent
Jones et al.

(10) Patent No.: US 6,209,473 B1
(45) Date of Patent: Apr. 3, 2001

(54) TREATMENT OF AN UNDERWATER SURFACE

(75) Inventors: David Fitzherbert Jones, Lymington; Joseph Jackson, Havant, both of (GB)

(73) Assignee: UMC International Plc, Hampshire (GB)

( * ) Notice: Subject to any disclaimer, the term of this patent is extended or adjusted under 35 U.S.C. 154(b) by 0 days.

(21) Appl. No.: 09/423,907

(22) PCT Filed: Jun. 19, 1998

(86) PCT No.: PCT/GB98/01813

§ 371 Date: Nov. 16, 1999

§ 102(e) Date: Nov. 16, 1999

(87) PCT Pub. No.: WO98/58837

PCT Pub. Date: Dec. 30, 1998

(30) Foreign Application Priority Data

Jun. 23, 1997 (GB) ..... 9713179

(51) Int. Cl.[7] ..... B63B 59/00
(52) U.S. Cl. ..... 114/222
(58) Field of Search ..... 114/222; 15/1.7

(56) References Cited

U.S. PATENT DOCUMENTS

| | | | | |
|---|---|---|---|---|
| 3,946,692 | * | 3/1976 | Sierra et al. | 114/222 |
| 4,682,558 | * | 7/1987 | Broersz | 114/222 |
| 5,048,445 | * | 9/1991 | Lever et al. | 114/222 |
| 5,441,368 | | 8/1995 | Campbell . | |

FOREIGN PATENT DOCUMENTS

| | | |
|---|---|---|
| 35 35213 | 4/1986 | (DE) . |
| 1 046 826 | 10/1966 | (GB) . |
| 1 371 017 | 10/1974 | (GB) . |
| 2 135 571 | 9/1984 | (GB) . |
| 2 155 771 | 10/1985 | (GB) . |
| 2 194 136 | 3/1988 | (GB) . |

* cited by examiner

*Primary Examiner*—Ed Swinehart
(74) *Attorney, Agent, or Firm*—Dann, Dorfman, Herrell and Skillman; Henry H. Skillman

(57) ABSTRACT

A method of removing fouling from an underwater surface (16) coated with an antifouling paint involves generating, by means of at least one treating member (9, 10) spaced from the underwater surface to be cleaned, turbulence within the water surrounding the underwater surface so as to dislodge marine fouling adhered thereto. The invention also relates to apparatus for cleaning an underwater surface.

9 Claims, 2 Drawing Sheets

TREATMENT OF AN UNDERWATER SURFACE

FIELD OF THE INVENTION

This invention relates to a method of, and apparatus for, removing marine fouling from an underwater surface, e.g. a ship or boat hull, coated with an antifouling material of the type providing a surface of low adhesion for the marine fouling. Preferably, but not exclusively, the antifouling material is a non-biocidal antifouling material.

The outer surface of a boat hull needs to resist fouling caused by adhesion thereon of marine organisms such as barnacles and algae. Conventionally fouling has been inhibited by coating the boat hull with an antifouling paint containing a biocide for marine organisms which gradually leaches from the paint. Nowadays the continual leaching of toxic substances from a boat hull is considered to be an unacceptable contamination of the surrounding water.

More recently, antifouling paints have been developed based on hydrolysable copolymers, such as triorganotin polymers. With these paints, the layer of paint is gradually dissolved from the surface of the hull as the boat moves through the water. However, the effectiveness of this product is reduced since the period over which the paint is effective is limited. Moreover, poisonous substances are again leaked into the surrounding water.

Presently non-biocidal antifouling materials have been developed for application to the hulls of boats to prevent or resist the adhesion thereto of marine fouling organisms. Such non-biocidal antifouling materials conveniently comprise a silicone rubber, especially a room-temperature-vulcanised silicone rubber, on the surface of the hull. These antifouling materials provide a relatively smooth and slippery or "non-stick" surface for marine foulings, such as weeds and barnacles, and are referred to as low surface energy antifouling paints. During motion of the boat through the water, any such marine foulings which are attached to the coated boat hull become removed as a result of the movement of the boat through the water. The main advantage of such antifouling materials is that they do not leach poisonous materials, e.g. biocides, into the water. However, the antifouling material provides a relatively soft and delicate coating which, because it contains no biocides, is less effective at deterring the attachment of marine organisms thereto than biocidal antifouling materials. Therefore a hull coated with such an antifouling material requires subsequent cleaning to prevent the build up of marine foulings. A problem with cleaning such a coated hull is that, if scrubbed with brushes, the relatively soft and delicate antifouling material tends to become removed from the boat hull.

SUMMARY OF THE INVENTION

The present invention seeks to provide an apparatus and method for effectively cleaning hulls of boats or other underwater structures coated with antifouling paint of the type providing a surface of relatively low adhesion for the marine fouling.

According to one aspect of the present invention there is provided a method of removing marine fouling from an underwater surface coated with an antifouling paint of the type providing low adherence for marine fouling or growth, the method comprising generating, with at least one treating member spaced from the underwater surface to be cleaned, turbulence within the water surrounding the underwater surface to be cleaned so as to dislodge marine fouling adhering to the surface to be cleaned.

The turbulence within the water created by the at least one treating member has a similar effect as if the underwater surface, e.g. a boat hull, is moving through the water. Thus the generated water movement dislodges any marine fouling from the underwater surface without the need to contact the underwater surface directly with the treating member(s).

Preferably, the generation of the turbulence within the water is created by rotation of the or each treating member. The or each treating member conveniently comprises a disc having a number of vanes mounted thereon which on rotation of the treating member causes the desired turbulence within the water surrounding the underwater surface to be cleaned. The provision of a rotating treating member has the advantage of creating a suction force towards the underwater surface being cleaned in addition to creating localised high speed water movements. If the treatment member is mounted on a wheeled cleaning vehicle, the vehicle will be sucked against the underwater surface when the treating member is rotated.

According to another aspect of the present invention, there is provided apparatus for cleaning an underwater surface comprising a wheeled chassis maneuverable over the underwater surface to be cleaned and at least one surface treating member mounted on the chassis, characterised in that the or each surface treating member is constructed and arranged so that, in use of the apparatus under water, the or each treating member is spaced from the underwater surface to be cleaned and generates water movements over, so as to detach fouling from, the underwater surface.

Preferably the or each surface treating member is rotatably mounted on the chassis. In this case the apparatus further includes drive means for rotating said surface treating member(s) and, preferably, also control means for moving the or each treating member between inner and outer positions in both of which positions it is spaced, in use, from the underwater surface to be cleaned. Suitably the or each treating member comprises a plurality of vanes mounted on a backing plate.

If the or each treating member is a rotatable treating member, its rotation, in use of the apparatus underwater, also serves to generate a suction force holding the apparatus against the underwater surface to be cleaned.

BRIEF DESCRIPTION OF THE DRAWINGS

An embodiment of the invention will now be described, by way of example only, and with particular reference to the accompanying drawings, in which.

DESCRIPTION OF THE PREFERRED EMBODIMENT

Figure 1:
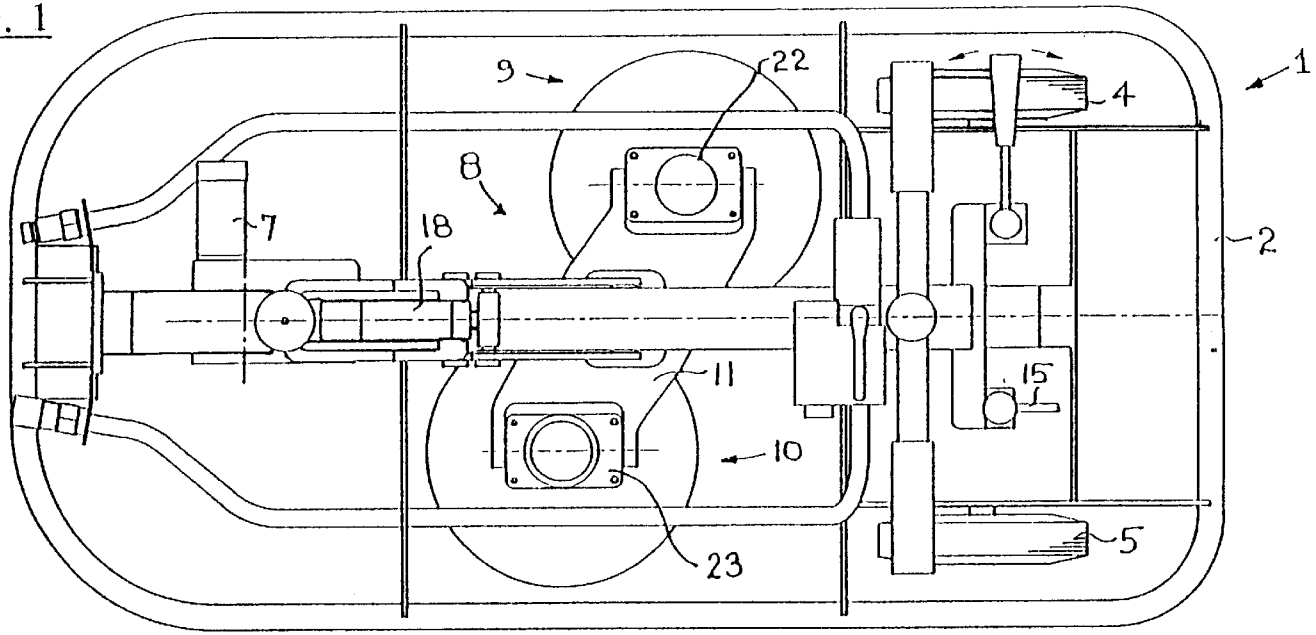
FIG. 1 is a view from above of an apparatus for treating an underwater surface.
Figure 2:
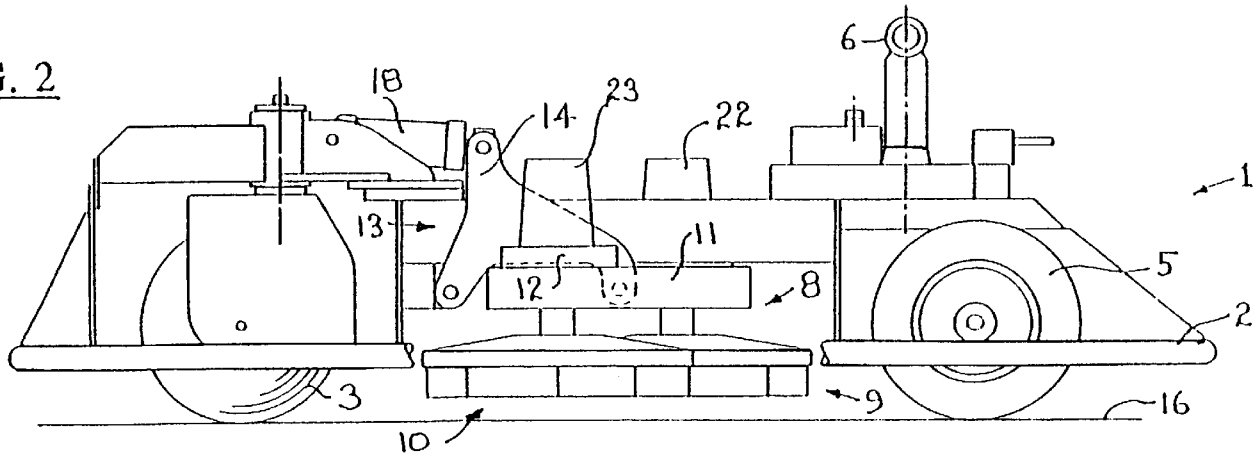
FIG. 2 is a partly cut away side view of the apparatus shown in FIG. 1.

FIGS. 1 and 2 show apparatus 1 for cleaning an underwater surface 16, such as the hull of a ship or boat, comprising a wheeled chassis 2 having a single back wheel 3 and a pair of front wheels 4 and 5. The chassis 2 mounts a steering mechanism including a steering handle bar 6, a propulsion motor 7, and a cleaning head assembly generally designated by the reference numeral 8.

Figure 3:
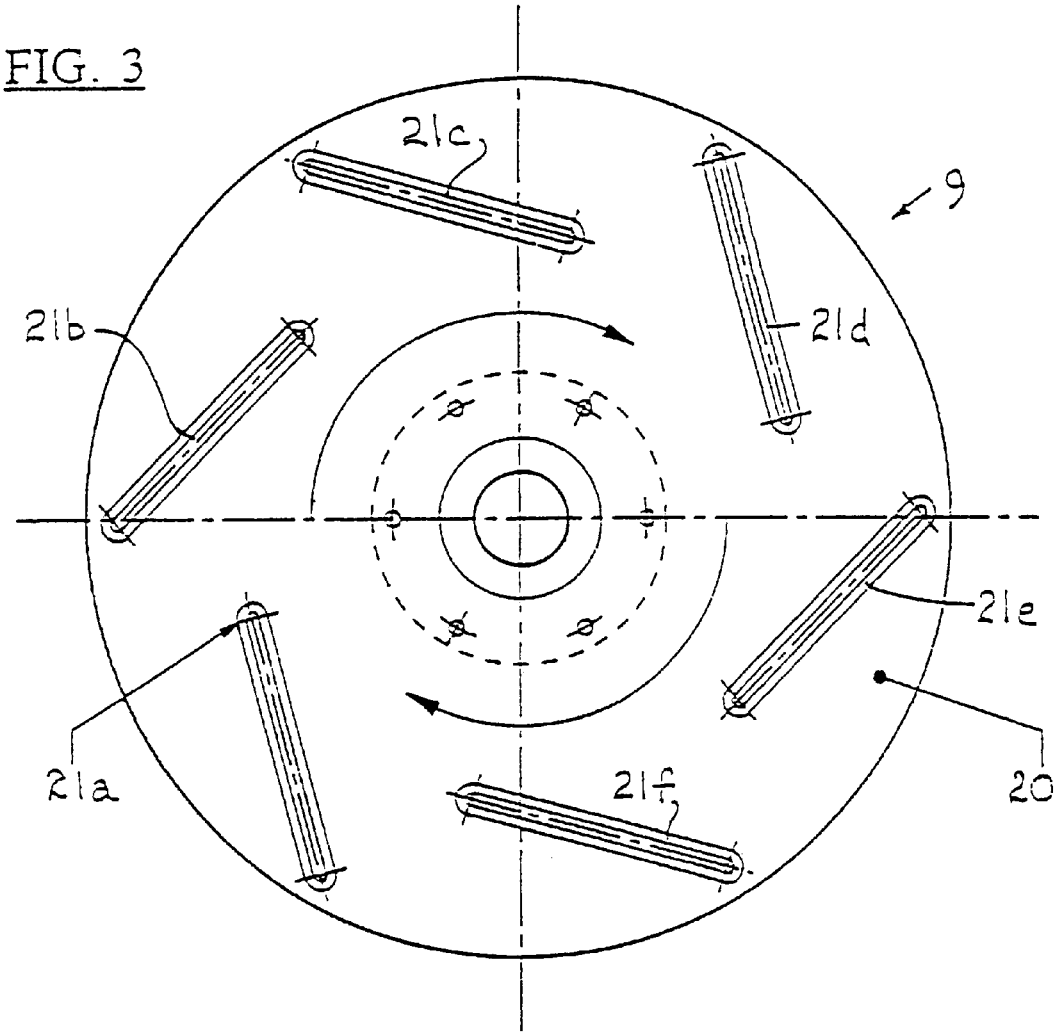
FIG. 3 is a view from below on an enlarged scale of a treating member of the apparatus shown in FIGS. 1 and 2.
Figure 4:
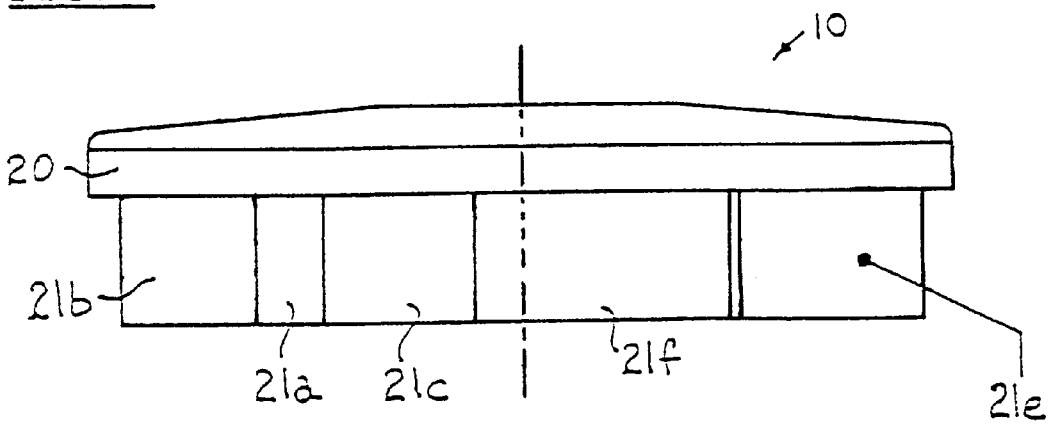
FIG. 4 is a side view of the treating member shown in FIG. 3.

The cleaning head assembly 8 comprises a pair of cleaning heads 9 and 10 mounted on a connecting plate 11. The plate is pivotally connected to one arm 12 of a lever arm mechanism 13 which is pivoted to the chassis 2. The other arm 14 of the lever arm mechanism is pivotally connected to a hydraulically actuated ram 18 connected to the chassis 2. Actuation of the ram 18 via a control knob 15 enables adjustment of the position of the plate 11 and the positions of the treating heads 9 and 10 relative to an underwater surface 16 to be cleaned. The cleaning head 9 is shown in more detail in FIGS. 3 and 4 and includes a circular backing plate or board 20 and a plurality of angularly spaced apart vanes 21*a*–21*f* mounted on, and projecting forwardly from, the board 20. Each cleaning head 9, 10 is rotated by a hydraulic motor 22,23, respectively.

In use, the distance that the cleaning heads 9 and 10 are spaced from the underwater surface 16 to be cleaned can be adjusted between inner and outer positions. In both the inner and outer positions of the cleaning heads, the vanes of the cleaning heads are spaced from the underwater surface 16 to be cleaned.

The apparatus 1 is intended to clean underwater surfaces and in particular surfaces coated with antifouling paint of the type providing low adherence for marine fouling. Such antifouling paints are known as low surface energy antifouling paints and are marketed under names such as "Biox" (Kansai Paint Company), "Intersleek" (International Paint PLC), "Everclean" (Nippon Oil & Fats) and "Bioclean" (Chugoku). These antifouling paints are characterised by providing a low-adhesion or "non-stick" surface and are generally damaged relatively quickly if scrubbed by means of conventional hull-cleaning brushes. These low surface energy antifouling paints are generally characterised as being non-biocidal antifouling materials which in use on an underwater surface do not poison the surrounding water to any great extent.

In use of the apparatus 1 to clean an underwater hull coated with a low surface energy antifouling paint of the type referred to above, the apparatus is positioned against the coated underwater surface 16 of the hull to be cleaned and the cleaning heads 9 and 10 are moved to their inner positions. Rotation of the cleaning heads 9 and 10 at a small distance away from the underwater surface 16 generates a suction force pulling the apparatus, which will typically have a substantially neutral buoyancy in sea water, against the surface 16. On operation of the propulsion motor 7 to drive the wheel 3, a diver (not shown) is able to manoeuvre the apparatus 1 over the underwater surface 16. The rotation of the heads 9 and 10, in addition to creating the suction force adhering the apparatus to the hull, also creates localised high speed water movements over the underwater surface 16. This turbulence is sufficient to dislodge any marine organisms adhering to the low surface energy antifouling coating applied to the surface 16.

Although the apparatus 1 has been described in relation to an apparatus for periodic cleaning of underwater surfaces provided with low surface energy antifouling paints, it will be appreciated that the apparatus can be modified to enable it to be used for cleaning other types of coated underwater surfaces. For example, other hull cleaning apparatus can be modified to accept the cleaning heads 9 and 10. With such modified cleaning apparatus, it is necessary for the heads 9 and 10 in use to be spaced from the underwater surface to be cleaned so that when they are rotated the necessary water currents are generated to remove any marine organisms. An example of another type of machine which could be modified to incorporate the cleaning heads 9 and 10 is shown in GB-A-2155771. With such apparatus, the rotating cleaning heads would be operated so as to be spaced from the underwater surface to be treated so as to generate the desired water movements necessary to clean the underwater surface.

By way of reference only, each cleaning head typically has a diameter of about 330 mm and is rotatable at speeds of between 100 to 1000 rpm, typically 500 rpm. Suitably each vane 21 is substantially rigid, made, for example, of stiff rubber and projects forwardly about 50 mm from the backing board 20.

What is claimed is:

1. A method of removing marine fouling from an underwater surface coated with an antifouling paint providing low adherence for marine fouling or growth, the method involving the use of a chassis adapted to travel on said surface, and having at least one rotary treating member, and mounting means for the at least one treating member to hold the at least one member spaced apart from, so as not to contact, the underwater surface, said method comprising the step of rotating the at least one treating member and generating turbulence within the water surrounding the underwater surface to be cleaned thereby dislodging marine fouling adhering to the surface and creating a suction force urging the at least one rotary treating member towards the underwater surface being treated, and maintaining said at least one treating member held spaced from the underwater surface.

2. A method according to claim 1, wherein said at least one treating member comprises a disc having a number of vanes mounted thereon which, on rotation of the treating member, causes said turbulence within the water surrounding the underwater surface to be cleaned.

3. A method according to claim 1, wherein said chassis is a wheeled chassis, said suction force pulling the wheeled chassis against the underwater surface when the at least one treating member is rotated.

4. Apparatus for cleaning an underwater surface comprising a chassis maneuverable on the underwater surface to be cleaned, at least one rotatable treating member, means mounting said member on the chassis, and drive means for rotating said at least one treating member wherein said means mounting said treating member is constructed and arranged so that, when said chassis is on the underwater surface, the said at least one treating member is spaced from the underwater surface, and when rotated by said drive means in its position spaced from the underwater surface, the member generates water movements over the underwater surface so as to detach fouling from the underwater surface and creates a suction force to hold the chassis against the underwater surface being cleaned without allowing the member to engage the surface.

5. Apparatus according to claim 4, wherein said at least one treating member is rotatably mounted on the chassis by said mounting means.

6. Apparatus according to claim 4, wherein said mount means includes control means for moving said at least one treating member between inner and outer positions in both of which positions it is spaced from the underwater surface to be cleaned when said chassis is on said surface.

7. Apparatus according to claim 4, wherein said at least one treating member comprises a plurality of vanes, and a backing plate mounting said vanes.

8. Apparatus according to claim 7 wherein said plate has a circular mounting surface adapted to confront said underwater surface, said mounting means mounting said plate for rotation about the center of said mounting surface, each of said vanes being elongated and spaced from said center and having a longitudinal center line disposed at an acute angle to a radial line from said center.

9. Apparatus according to claim 4 wherein said chassis is a wheeled chassis having wheels adapted to roll on the underwater surface and adapted to be held against the surface by said suction force.

* * * * *